US011732999B2

(12) United States Patent
Gong et al.

(10) Patent No.: US 11,732,999 B2
(45) Date of Patent: Aug. 22, 2023

(54) ERECTION DEVICE AND METHOD FOR MARINE HOT LAUNCH OF ROCKET

(71) Applicant: Ludong University, Yantai (CN)

(72) Inventors: Qingtao Gong, Yantai (CN); Yao Teng, Yantai (CN); Fuzhen Pang, Yantai (CN); Kangqiang Li, Yantai (CN); Haichao Li, Yantai (CN); Yuan Du, Yantai (CN); Shoujun Wang, Yantai (CN); Gang Wang, Yantai (CN); Kechang Shen, Yantai (CN); Shilong He, Yantai (CN); Liyan Jin, Yantai (CN)

(73) Assignee: Ludong University, Yantai (CN)

( * ) Notice: Subject to any disclaimer, the term of this patent is extended or adjusted under 35 U.S.C. 154(b) by 0 days.

(21) Appl. No.: 17/923,245

(22) PCT Filed: Dec. 2, 2021

(86) PCT No.: PCT/CN2021/135006
§ 371 (c)(1),
(2) Date: Nov. 4, 2022

(87) PCT Pub. No.: WO2022/242106
PCT Pub. Date: Nov. 24, 2022

(65) Prior Publication Data

US 2023/0213310 A1 Jul. 6, 2023

(30) Foreign Application Priority Data

May 20, 2021 (CN) ..... 202110550210.8

(51) Int. Cl.
*F41F 3/04* (2006.01)

(52) U.S. Cl.
CPC ..... *F41F 3/04* (2013.01)

(58) Field of Classification Search
CPC ..... F41F 3/04
(Continued)

(56) References Cited

U.S. PATENT DOCUMENTS 2,735,391 A * 2/1956 Buschers ..... B64F 1/04 89/1.819
3,217,900 A * 11/1965 Kupetzky ..... F41A 9/13 414/742

(Continued)

FOREIGN PATENT DOCUMENTS

BE 717473 A 12/1968
CA 2075638 A1 6/1992

(Continued)

OTHER PUBLICATIONS

T. Ito, et al., Sounding rocket SS-520 as a CubeSat launch vehicle, Acta Astronautica, 2020, pp. 206-223, vol. 170.

(Continued)

*Primary Examiner* — Reginald S Tillman, Jr.
(74) *Attorney, Agent, or Firm* — Bayramoglu Law Offices LLC

(57) ABSTRACT

An erection device and method for the marine hot launch of a rocket are provided. The erection device includes a launch vessel, a launch pad, an erection assembly, a guide member, a driving cylinder, a sliding member, and a connecting member. The sliding member cooperates with the guide member and is driven by the driving cylinder to move linearly. The connecting member has one end hinged to the erection assembly at a certain angle and the other end connected to the sliding member and is configured to move with the sliding member to drive the erection assembly to be erected on the launch pad. The erection device and method can achieve an effective erection of the rocket for marine hot launch with a desired erection effect and high stability.

18 Claims, 1 Drawing Sheet

(58) Field of Classification Search
USPC ..... 89/1.804, 1.8, 1.802, 1.815, 1.819
See application file for complete search history.

(56) References Cited

U.S. PATENT DOCUMENTS

| | | | | | |
|---|---|---|---|---|---|
| 3,303,740 | A * | 2/1967 | Grayson | F41F 3/042 | 89/1.819 |
| 3,340,768 | A * | 9/1967 | Kindrot | F41F 3/0406 | 89/1.815 |
| 5,191,162 | A | 3/1993 | Czimmek | | |
| 5,918,306 | A * | 6/1999 | Kristensen | F41F 3/04 | 89/1.801 |
| 7,854,189 | B1 * | 12/2010 | Fox | F41F 3/077 | 89/1.804 |
| 2015/0101479 | A1 | 4/2015 | Essbaum | | |

FOREIGN PATENT DOCUMENTS

| | | | |
|---|---|---|---|
| CN | 206056393 | U | 3/2017 |
| CN | 109677567 | A | 4/2019 |
| CN | 110345813 | A | 10/2019 |
| CN | 110360882 | A | 10/2019 |
| CN | 110425931 | A | 11/2019 |
| CN | 110745056 | A | 2/2020 |
| CN | 111006546 | A | 4/2020 |
| CN | 111268172 | A | 6/2020 |
| CN | 111301714 | A | 6/2020 |
| CN | 112113464 | A | 12/2020 |
| CN | 113218246 | A | 8/2021 |
| DE | 2629598 | A1 | 1/1978 |
| DE | 102018004549 | B3 * | 10/2019 |
| RU | 2345925 | C1 | 2/2009 |

OTHER PUBLICATIONS

Song Yongsheng, et al., Analysis of Sea Launch Demand and Application Prospect of Solid Launch Vehicle, Aerospace China, 2019, pp. 13-16.

* cited by examiner

ERECTION DEVICE AND METHOD FOR MARINE HOT LAUNCH OF ROCKET

CROSS REFERENCE TO THE RELATED APPLICATIONS

This application is the national phase entry of International Application No. PCT/CN2021/135006, filed on Dec. 2, 2021, which is based upon and claims priority to Chinese Patent Application No. 202110550210.8, filed on May 20, 2021, the entire contents of which are incorporated herein by reference.

TECHNICAL FIELD

The present disclosure relates to the field of rocket hot-launch and, in particular, to an erection device and method for the marine hot launch of a rocket.

BACKGROUND

In the field of rocket launching, the launch pad is usually composed of a fixing frame and an erecting frame hinged through a rotary shaft. A hydraulic cylinder is directly connected to the erecting frame to make the erecting frame rotate around the rotary shaft. The rocket is hoisted and fixed to the erecting frame, and the erecting frame is rotated around the rotary shaft through an erection system to erect the rocket. Compared with the land launch, the marine launch has received more attention due to its low launch cost and low launch energy loss.

In the process of marine launch, due to the characteristics of the ship moving at sea, the ship has acceleration in the horizontal direction and will tilt and sway, which will generate a certain side force on the erection device. The hydraulic cylinder that is configured with soft rubber for sealing and is configured for erecting a rocket carries great weight. Once the hydraulic cylinder is subjected to a side load, its rubber piece for sealing will be damaged and cause hydraulic oil leakage, which will greatly affect the thrust and accuracy of the hydraulic system. In addition, the rocket launch requires the extremely high stability of the erection device. To ensure the launch quality, it is often necessary to set up a backup hydraulic system. However, in a marine launch, the launch vessel has limited space which cannot satisfy normal backup of the hydraulic system. Therefore, the existing land rocket erection solution cannot be directly applied at sea, that is, the existing hydraulic erection device cannot be applied to marine launch.

SUMMARY

Technical Problem

The existing marine launch pad usually uses a flexible wire rope erection system to carry out a rocket erection. Chinese Patent Application 201910653531.3 discloses a hoisting and erecting system and erecting control method for a marine rocket launch pad, which uses a hoister and a wire rope to erect the rocket at sea.

During the hot launch of the rocket, the high-temperature flame emitted by the rocket will burn the erection device with the hoister and the wire rope, which will cause the erection to fail, thereby causing the rocket to be damaged and the launch to fail. Therefore, the above technical solution is only applicable to marine cold launches, rather than marine hot launches.

In view of this, it is necessary to provide a new technical solution to solve the above problem.

Technical Solution

The present disclosure provides an erection device for the marine hot launch of a rocket, which can achieve an effective erection of the rocket for marine hot launch with a desired erection effect and high stability.

To solve the above technical problem, the present disclosure provides an erection device for the marine hot launch of a rocket, including:

a launch vessel;

a launch pad provided on the launch vessel and configured to place a rocket to be launched;

an erection assembly hinged to the launch pad and configured to support the rocket during erection;

a guide member including a linearly provided guide cavity, fixedly connected to a deck of the launch vessel, and parallel to the orthographic projection of an axis of the rocket on the deck of the launch vessel;

a driving cylinder fixedly connected to the deck of the launch vessel and configured to provide a driving force for erecting the rocket;

a sliding member adapted to and slidable along the guide cavity and connected to a moving end of the driving cylinder to move synchronously with the driving cylinder; and a connecting member provided with one end hinged to the erection assembly and the other end hinged to the sliding member and configured to move with the sliding member to drive the erection assembly to be erected on the launch pad.

Preferably, the erection assembly may include an erecting frame and a support frame. The erecting frame may be fixed to a side of the support frame and may be detachably connected to the support frame. The erecting frame may be hinged to the connecting member.

Preferably, the guide member may include multiple linearly arranged guide pieces, and space is arranged between adjacent guide pieces.

Preferably, the guide member further may include a friction plate and/or a guide plate provided in the guide cavity.

Preferably, the friction plate may be made of a copper alloy and may have an upper surface including a lubricating groove.

Preferably, the guide plate may be made of a copper alloy or an engineering plastic alloy.

Preferably, the guide member further may include a limiting plate.

Preferably, the sliding member may include a guide slope, which may be provided at each of the front side bottom and the rear side bottom of the sliding member in a moving direction.

Preferably, an angle between the connecting member and a plane where the deck of the launch vessel is located may be 5-60°.

Another aspect of the present disclosure further provides an erection method for the erection device for the marine hot launch of a rocket, including the following steps:

step 1: determining an inclination at which the rocket does not fall after being erected according to the weight and the center of gravity of the rocket;

step 2: taking the inclination at which the rocket does not fall after being erected as the main design goal, selecting a suitable skylight period, and determining the main dimensions of the launch vessel;

step 3: determining outer dimensions of the erection assembly according to a take-off drift of the rocket;

step 4: determining the connection position of the erection assembly and the connecting member, the length and load of the connecting member, and the initial and final positions of the sliding member in the erection device, according to the outer dimensions of the erection assembly and a bearing capacity and stroke of an existing driving cylinder;

step 5: determining a load, stroke, and count of the driving cylinder;

step 6: performing a necessary strength calculation and failure mode analysis on the erection device based on the data acquired in steps 1 to 5;

step 7: assembling the erection device;

step 8: debugging the erection device;

step 9: manufacturing a model rocket, and conducting, by the erection device, a simulated erection test;

step 10: fixing a rocket to the erection device for an erection test; and step 11: carrying, by the launch vessel, the rocket to a designated launch sea area, and performing a marine rocket erection and the hot launch of the rocket.

Beneficial Effects

Compared with the prior art, the present disclosure has at least the following beneficial effects.

1. The sliding member connected to the connecting member is driven by the driving cylinder, and the effective erection is realized for the marine hot launch of the rocket through the hinge action of the connecting member and the erection assembly.

2. The guide member and the sliding member cooperate to avoid the influence of the horizontal sliding force and the bending moment in the horizontal plane caused by the horizontal acceleration and sway of the launch vessel on the driving cylinder. The sliding member is only subjected to the force along the extension and retraction direction of the driving cylinder to ensure that the seal of the driving cylinder will not be damaged by an external force, thereby ensuring the stability and effectiveness of the driving cylinder.

3. The driving cylinder is fixedly connected to the deck of the launch vessel, such that the initial length of the driving cylinder is not limited, thereby increasing the load of the driving cylinder, increasing the stroke, and improving the stability.

4. The driving cylinder is provided at an end away from the launch pad to reduce the high temperature generated by the rocket launch from affecting the driving cylinder and its hydraulic system, thereby reducing the potential safety hazard.

BRIEF DESCRIPTION OF THE DRAWINGS

Some specific embodiments of the present disclosure will be described in detail below in an illustrative rather than restrictive manner with reference to the drawings. The same reference numerals in the drawings refer to like or similar components or parts. Those skilled in the art should understand that the drawings are not drawn to scale. Drawings.

Figure 1:
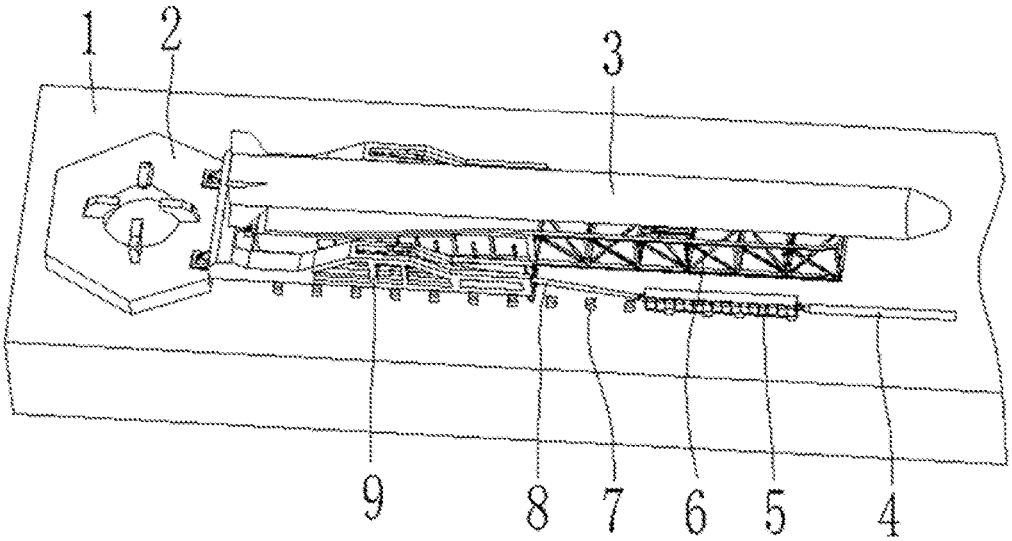
FIG. 1 is a structural diagram of an erection device for the marine hot launch of a rocket according to the present disclosure.

Reference Numerals:

1. launch vessel; 2. launch pad; 3. rocket; 4. driving cylinder; 5. sliding member; 6. support frame; 7. guide member; 8. connecting member; and 9. erecting frame;

51. main body of sliding member; and 52. guide slope; and

71. guide piece; 72. guide plate; 73. lower friction plate; 74. upper friction plate; 75. limiting plate; and 76. guide cavity.

DETAILED DESCRIPTION OF THE EMBODIMENTS

To make the objective, technical solutions, and advantages of the present disclosure clearer, the technical solutions in the present disclosure are clearly and completely described below with reference to specific embodiments and corresponding drawings of the present disclosure. The described embodiments are some, rather than all, the embodiments of the present disclosure. All other embodiments obtained by those of ordinary skill in the art based on the embodiments of the present disclosure without creative efforts should fall within the protection scope of the present disclosure.

Figure 3:
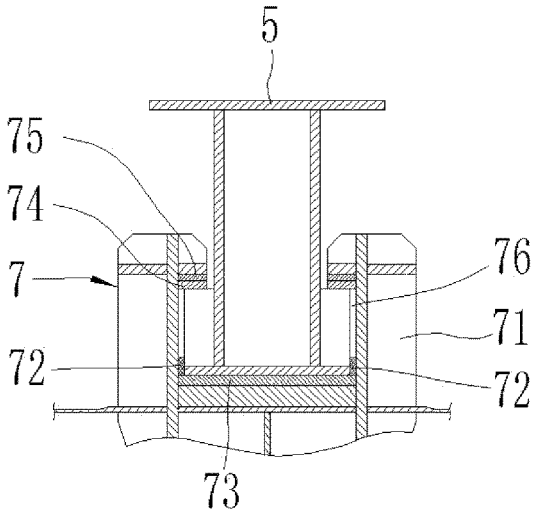
FIG. 3 is a sectional view taken along A-A shown in FIG. 2.

As shown in FIGS. 1 and 3, an erection device for the marine hot launch of a rocket includes a launch vessel 1, a launch pad 2, an erection assembly, a guide member 7, a driving cylinder 4, a sliding member 5, and a connecting member 8. The launch pad 2 is provided on the launch vessel 1 and is configured to place the rocket 3 to be launched. The erection assembly is hinged to the launch pad 2 and is configured to support the rocket 3 during erection. The erection assembly includes a support frame 6 and an erecting frame 9. The support frame 6 is connected to the rocket 3 and is configured to support the rocket 3 during erection. The support frame 6 and the erecting frame 9 are hinged to the launch pad 2. The erecting frame 9 is connected to the launch pad 2 through a hinge point and can rotate around the launch pad 2 from a horizontal state to a vertical state. The support frame 6 and the erecting frame 9 are made of a high-rigidity profile that withstands a high temperature during the launch of the rocket 3. This design prevents the support frame 6 and the erecting frame 9 from being damaged by the high temperature during the launch of the rocket 3 on the premise of the smooth erection of the rocket 3. The guide member 7 includes a guide cavity 76 and is fixedly connected to a deck of the launch vessel 1. The guide member 7 is parallel to the orthographic projection of an axis of the rocket 3 on a horizontal plane.

The driving cylinder 4 is provided horizontally, fixedly connected to the deck of the launch vessel 1, and configured to provide a driving force for erecting the rocket 3. Since the driving cylinder 4 is provided horizontally, its initial length is not limited. Therefore, the number of stages of the driving cylinder 4 can be reduced, and the stroke thereof can be increased. For example, if a 160-ton driving cylinder 4 is directly connected to the erecting frame 9, its initial length is limited. The driving cylinder needs to extend 4 stages to form a 5-stage oil cylinder to achieve a stroke of at least 18 m. Therefore, the initial length of the horizontally provided driving cylinder 4 is not limited, and it only needs to extend 2 stages to form a 3-stage oil cylinder to achieve a stroke of at least 18 m, which greatly improves the reliability of the driving cylinder 4.

The sliding member 5 is adapted to the guide cavity 76 and is slidable linearly along the guide cavity 76 of the guide member 7. One end of the sliding member 5 is connected to a moving end of the driving cylinder 4 and moves synchronously with the driving cylinder 4. The connecting member 8 has one end hinged to the erecting frame 9 and the other end hinged to the sliding member 5. The connecting member 8 is hinged to the erecting frame 9 and relies on the sliding member 5 matched with the guide member 7 to transmit power provided by the driving cylinder 4. It can convert the linear motion of the horizontally provided driving cylinder 4 into the rotational motion of the support frame 6. During the marine hot launch of the rocket 3, this design effectively avoids the failure of the seal of the hydraulic cylinder caused by the acceleration of the launch vessel 1 in the horizontal direction and the inclination and sway of the launch vessel 1. In addition, the sliding member 5 cooperates with the erecting frame 9, and the sliding member 5 cooperates with the guide member 7. In this way, the driving cylinder 4 can be placed at an end away from the launch pad 2. During the launch of the rocket 3, this design effectively avoids the influence of the high temperature on the driving cylinder 4 and the corresponding hydraulic system, thereby reducing potential safety hazards. The connecting member 8 is at a certain angle with the erecting frame 9. Specifically, when the sliding member 5 is in an initial position, an angle between the connecting member 8 and a plane where the deck of the launch vessel 1 is located is 5-30°. When the sliding member 5 is in a final position, the angle between the connecting member 8 and the plane where the deck of the launch vessel 1 is located is 30-60°. The connecting member 8 and the plane where the deck of the launch vessel 1 is located are within the angle range, ensuring that the stroke of the driving cylinder 4 is within the range of the existing cylinder and effectiveness of the driving cylinder 4 within the stroke range. Meanwhile, the connecting member 8 can effectively support the erecting frame 9, effectively transmit the power transmitted by the sliding member 5 to the erecting frame 9, and prevent jamming from occurring during erection. In addition, within the angle range, the connecting member 8 can effectively control the position of the erecting frame 9 to prevent stalling that may be caused when the overall center of the mass of the support frame 6 and the rocket crosses a vertical plane where the rotary shaft is located during erection.

In some preferred embodiments of the present disclosure, the erecting frame 9 is provided on a side of the support frame 6 and is connected to the support frame 6 through a detachable connection, such as a bolt connection. Due to the different specifications of the support frame 6 required by the different types of rockets 3, the erecting frame 9 is detachably connected to the support frame 6, such that the hinged position of the erecting frame 9 and the launch pad 2 is fixed. When launching different types of rockets 3, the support frame 6 and the rocket 3 are fixed and moved to the launch vessel 1, and the erecting frame 9 is fixedly connected to the support frame 6. This design enables modular installation, reduces launch steps, improves launch efficiency, and reduces launch costs.

Figure 2:
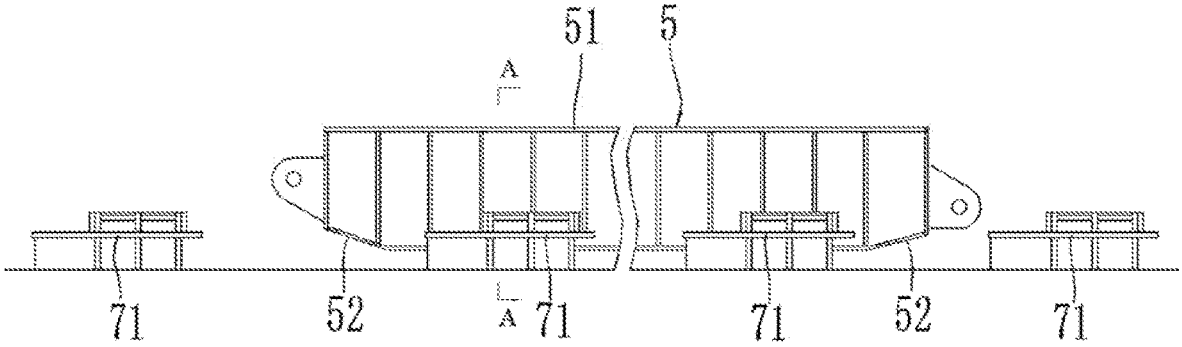
FIG. 2 is a structural diagram of a sliding member connected to a guide member.

As shown in FIG. 2, the guide member 7 includes multiple linearly arranged guide pieces 71. Space is arranged between adjacent guide pieces 71. This design saves costs and avoids deformation of the connection between the guide member 7 and the deck of the launch vessel 1 without affecting the strength and rigidity of the deck at the connection between the launch vessel 1 and the guide member 7.

The sliding member 5 includes a main body 51, which has a length greater than the spacing between the adjacent guide pieces 71, such that the sliding member 5 is movable linearly along the guide member 7 without derailing. A guide slope 52 is provided at each of the front side bottom and a rear side bottom of the main body 51 in a moving direction. In an initial contact stage of the sliding member 5 with the guide piece 71 during sliding, the guide slope 52 effectively prevents jamming from occurring due to a machining error and a vertical component force of the erecting frame 9 connected to the rocket 3.

In some preferred embodiments of the present disclosure, the guide member 7 is an integral guide piece 71 with a guide cavity 76. The guide cavity 76 is provided linearly, such that the sliding member 5 can slide along the guide cavity 76 to erect the erection assembly equipped with the rocket 3. The integral guide member 7 has good straightness and effectively reduces the jamming of the sliding member 5 due to dimensional errors, such as straightness.

As shown in FIG. 3, the guide piece 71 includes the guide cavity 76 communicating with an upper part. A limiting plate 75 is provided on an upper top surface of the guide cavity 76. After the erection assembly and the rocket 3 cross the overall center of mass, the pressure on the connecting member 8 becomes a pulling force, and an upward pulling force is generated on the sliding member 5. The limiting plate 75 limits the sliding member 5 to prevent upward displacement of the sliding member 5 to affect the accuracy of the erection position of the rocket 3.

A lower friction plate 73 is provided on an upper bottom surface of the guide cavity 76 in contact with a lower surface of the sliding member 5 and configured to slidingly support the sliding member 5. The lower friction plate 73 is preferably made of a copper alloy, which has certain hardness and a low friction coefficient and can effectively support the sliding member 5. Meanwhile, it can effectively reduce the frictional force with the sliding member 5, thereby effectively reducing the load of the driving cylinder 7, ensuring the stability and smoothness of the power output of the driving cylinder 7, and improving the safety performance. An upper friction plate 74 is provided on a lower surface of the limiting plate 75 and is adapted to the size of the limiting plate 75. Like the lower friction plate 73, the upper friction plate reduces the friction coefficient and the friction force between the sliding member 5 and the guide piece 71. The upper friction plate 74 is preferably made of a copper alloy or an engineering plastic alloy. The lower friction plate 73 and the upper friction plate 74 are collectively referred to as a friction plate.

In some preferred embodiments of the present disclosure, an upper surface of the lower friction plate 73 is provided with a lubricating groove (not shown in the figure). A lubricating fluid can be charged into the lubricating groove to further reduce the friction between the sliding member 5 and the guide piece 71 to further improve the stability and smoothness of the power output of the driving cylinder 7 and reduce the load of the driving cylinder 7.

In some preferred embodiments of the present disclosure, the guide piece 71 further includes guide plates 72 symmetrically provided on an inner side wall of the guide cavity 76. The guide plates 72 are preferably made of a copper alloy or an engineering plastic alloy. A horizontal load occurs on the connecting member 8 due to the swaying of the erection assembly at sea under the influence of the launch vessel. The horizontal load is further transmitted to the sliding member 6, generating a horizontal sliding force and a bending moment in the horizontal plane on the sliding member 6. Further, a certain inclination of the sliding member 6 may be generated in the guide cavity 76, resulting in jamming. The guide piece 71 can resist the side force and the bending moment in the horizontal plane to effectively prevent the sliding member 6 from being jammed in the guide cavity 76. Preferably, the guide plates 72 are in clearance fit with the inner side wall of the guide cavity 76.

To cope with the side load and ship tilting when carrying out the erection at sea, the traditional oil cylinder is replaced with the connecting member in the present disclosure, such that the side load caused by the tilting of the launch vessel directly acts on the connecting member. To push the erection assembly connected to the rocket to stand up and fall backward, the connecting member is connected to the sliding member matched with the guide member. By driving the sliding member through the driving cylinder, the connecting member is further driven to realize the standup and backward fall of the rocket connected to the erection member. The load of the rocket being erected is transmitted to the sliding member through the connecting member. Under the limiting action of the guide member, the sliding member only moves linearly on the deck and will not generate additional loads in other directions. Therefore, other loads in the horizontal direction will not affect the rubber seal of the driving cylinder, ensuring its effectiveness and stability of the driving cylinder. The driving cylinder does not directly drive the erection assembly but is fixedly connected to the deck of the launch vessel to drive the movement of the sliding member. In this way, the initial length of the driving cylinder is not limited, thereby increasing the load of the driving cylinder, extending the stroke, and improving the stability.

The various components of the erection device for the marine hot launch of a rocket are closely connected to form a whole to realize an effective erection for the marine hot launch of the rocket. These components cannot be split, and the superposition of separate components with similar functions cannot solve the corresponding technical problems in the present disclosure.

In this embodiment, an erection method of the erection device for the marine hot launch of the rocket is described by taking the erection of a large solid-fuel rocket at sea as an example. In this embodiment, the rocket weighs 135 tons, has a diameter of 2.64 m, a length of about 30 m, and a center of gravity of about 10.7 m from the bottom. The rocket is required to be erected in a sea state of level 5. The operation steps are further described below.

Step 1: According to the weight and center of gravity of the rocket 3 to be erected, the inclination at which the rocket 3 will not fall after being erected is determined to be 7°, that is, the maximum inclination allowed by the launch vessel 1 is 7°. However, considering the wind load, the maximum allowable inclination of the launch vessel 1 is determined to be 5.5°.

Step 2: The maximum allowable inclination of the launch vessel 1 is taken as the main design goal, and a suitable skylight period, such as 90%, is determined. In addition, the appropriate type and main dimensions of the launch vessel 1 are determined. According to relevant hydrodynamic calculations and specification formulas, the main dimensions of the launch vessel 1 are determined to be 152 m long, 61 m wide, and 8.5 m deep, and a designed draft is determined to be 5 m.

Step 3: According to a take-off drift of the rocket 3, the outer dimensions of the erection assembly composed of the support frame 6 and the erecting frame 9 are determined to include an outer width of 9.18 m and an inner width of 6.82 m.

Step 4: According to the outer dimensions of the erection assembly, the bearing capacity of the existing mature cylinder does not exceed 300 tons, and the stroke thereof does not exceed 20 m. The take-off drift of the rocket 3 and the height of the connection position of the erecting frame 9 and the connecting member 8 are not more than 3.45 m, and the length of the connecting member 8 is 18.7 m. Furthermore, the load of the connecting member 8 and the initial and final position of the sliding member 5 are determined.

Step 5: According to the load of the driving cylinder 4 determined in Step 4, that is, the total load of 532 tons and the stroke of 16.8 m, the load on each side is 268 tons. If a 300-ton cylinder is used, the allowance will be relatively small. Therefore, double cylinders are used, each with a load of 200 tons and a maximum stroke of 17.5 m.

Step 6: Necessary strength calculation and failure mode analysis are carried out for each component of the erection device based on the data acquired in Steps 1 to 5.

Step 7: The erection device is assembled.

Step 8: The erection device is debugged.

Step 9: A model rocket is manufactured, and a simulated erection test is conducted using the erection device. In addition, other functional tests and reliability tests of the erection device can be carried out on the launch vessel 1.

Step 10: The rocket 3 is fixed to the erection device for an erection test.

Step 11: The rocket 3 is carried by the launch vessel 1 to a designated launch sea area, and the rocket 3 is then erected and hot-launched.

Industrial Applicability

For ease of description, the spatially relative terms, such as "above", "on the upper side of", "on the upper surface of", and "on", can be used to describe the spatial positional relationship between components or features shown in the drawings. It should be understood that the spatially relative terms are intended to encompass different orientations of the components in use or operation in addition to those shown in the drawings. For example, if a component in the drawing is inverted, it is described as a component "above other component or structure" or "on other component or structure". Therefore, the component will be positioned as "below other component or structure" or "under other component or structure". Therefore, the exemplary term "above" may include both orientations "above" and "below". The component may also be positioned in other different ways (rotated by 90 degrees or in other orientations), but the relative description of the space should be explained accordingly.

It should be noted that the terms used herein are merely used for describing the specific embodiments but are not intended to limit the exemplary embodiments of the present disclosure. As used herein, the singular form is also intended to include the plural form unless otherwise indicated obviously from the context. Furthermore, it should be further understood that the terms "includes" and/or "including" used in this specification specify the presence of stated features, steps, operations, devices, components, and/or a combination thereof.

It should be noted that the terms such as "first" and "second" in the description and claims of the present disclosure and the above accompanying drawings are intended to distinguish between similar objects but do not necessarily indicate a specific order or sequence. The data described in such a way may be exchanged under proper conditions to make it possible to implement the described examples of the present disclosure in sequences except those illustrated or described herein.

The above described are merely preferred embodiments of the present disclosure and are not intended to limit the present disclosure. Those skilled in the art may make various changes and modifications to the present disclosure. Any modifications, equivalent substitutions, improvements, and the like made within the spirit and principle of the present disclosure should be included within the protection scope of the present disclosure.

What is claimed is:

1. An erection device for a marine hot launch of a rocket, comprising:

a launch vessel;

a launch pad, wherein the launch pad is provided on the launch vessel and is configured to place the rocket to be launched;

an erection assembly, wherein the erection assembly is hinged to the launch pad and is configured to support the rocket during an erection;

a guide member, wherein the guide member comprises a linearly provided guide cavity, the guide member is fixedly connected to a deck of the launch vessel, and the guide member is parallel to an orthographic projection of an axis of the rocket on the deck of the launch vessel;

a driving cylinder, wherein the driving cylinder is fixedly connected to the deck of the launch vessel and is configured to provide a driving force for erecting the rocket;

a sliding member, wherein the sliding member is adapted to and is slidable along the guide cavity; the sliding member is connected to a moving end of the driving cylinder to move synchronously with the driving cylinder; and a connecting member, wherein the connecting member is provided with one end hinged to the erection assembly and the other end hinged to the sliding member; the connecting member is configured to move with the sliding member to drive the erection assembly to be erected on the launch pad.

2. The erection device for the marine hot launch of the rocket according to claim 1, wherein the erection assembly comprises an erecting frame and a support frame; the erecting frame is fixed to a side of the support frame, and is detachably connected to the support frame; and the erecting frame is hinged to the connecting member.

3. The erection device for the marine hot launch of the rocket according to claim 1, wherein the guide member comprises multiple linearly arranged guide pieces; and a space is arranged between adjacent guide pieces.

4. The erection device for the marine hot launch of the rocket according to claim 1, wherein the guide member further comprises a friction plate and/or a guide plate provided in the guide cavity.

5. The erection device for the marine hot launch of the rocket according to claim 4, wherein the friction plate is made of a copper alloy; and the friction plate has an upper surface comprising a lubricating groove.

6. The erection device for the marine hot launch of the rocket according to claim 4, wherein the guide plate is made of a copper alloy or an engineering plastic alloy.

7. The erection device for the marine hot launch of the rocket according to claim 4, wherein the guide member further comprises a limiting plate.

8. The erection device for the marine hot launch of the rocket according to claim 1, wherein the sliding member comprises a guide slope; and the guide slope is provided at each of a front side bottom and a rear side bottom of the sliding member in a moving direction.

9. The erection device for the marine hot launch of the rocket according to claim 1, wherein an angle between the connecting member and a plane where the deck of the launch vessel is located is 5-60°.

10. An erection method for the erection device for the marine hot launch of the rocket according to claim 1, comprising the following steps:

step 1: determining an inclination at which the rocket does not fall after being erected according to a weight and a center of gravity of the rocket;

step 2: taking the inclination at which the rocket does not fall after being erected as a main design goal, selecting a suitable skylight period, and determining main dimensions of the launch vessel;

step 3: determining outer dimensions of the erection assembly according to a take-off drift of the rocket;

step 4: determining a connection position of the erection assembly and the connecting member, a length and a load of the connecting member, and initial and final positions of the sliding member in the erection device for the marine hot launch of the rocket according to the outer dimensions of the erection assembly and a bearing capacity and a stroke of an existing driving cylinder;

step 5: determining a load, a stroke, and a count of the driving cylinder;

step 6: performing a necessary strength calculation and a failure mode analysis on the erection device for the marine hot launch of the rocket based on the data acquired in steps 1 to 5;

step 7: assembling the erection device for the marine hot launch of the rocket;

step 8: debugging the erection device for the marine hot launch of the rocket;

step 9: manufacturing a model rocket, and conducting, by the erection device for the marine hot launch of the rocket, a simulated erection test;

step 10: fixing a rocket to the erection device for the marine hot launch of the rocket for an erection test; and step 11: carrying, by the launch vessel, the rocket to a designated launch sea area, and performing a marine rocket erection and the hot launch of the rocket.

11. The erection method according to claim 10, wherein in the erection device, the erection assembly comprises an erecting frame and a support frame; the erecting frame is fixed to a side of the support frame, and is detachably connected to the support frame; and the erecting frame is hinged to the connecting member.

12. The erection method according to claim 10, wherein in the erection device, the guide member comprises multiple linearly arranged guide pieces; and a space is arranged between adjacent guide pieces.

13. The erection method according to claim 10, wherein in the erection device, the guide member further comprises a friction plate and/or a guide plate provided in the guide cavity.

14. The erection method according to claim 13, wherein in the erection device, the friction plate is made of a copper alloy; and the friction plate has an upper surface comprising a lubricating groove.

15. The erection method according to claim 13, wherein in the erection device, the guide plate is made of a copper alloy or an engineering plastic alloy.

16. The erection method according to claim 13, wherein in the erection device, the guide member further comprises a limiting plate.

17. The erection method according to claim 10, wherein in the erection device, the sliding member comprises a guide slope; and the guide slope is provided at each of a front side bottom and a rear side bottom of the sliding member in a moving direction.

18. The erection method according to claim 10, wherein in the erection device, an angle between the connecting member and a plane where the deck of the launch vessel is located is 5-60°.

* * * * *